US007703944B2

(12) United States Patent
Flüss et al.

(10) Patent No.: US 7,703,944 B2
(45) Date of Patent: Apr. 27, 2010

(54) LIGHTING CONTROL SYSTEM

(75) Inventors: Holger Flüss, Remscheid (DE); Jens Von Der Brelie, Frankfurt (DE)

(73) Assignee: ERCO GmbH, Lundenscheid (DE)

( * ) Notice: Subject to any disclaimer, the term of this patent is extended or adjusted under 35 U.S.C. 154(b) by 150 days.

(21) Appl. No.: 11/975,903

(22) Filed: Oct. 22, 2007

(65) Prior Publication Data

US 2008/0170387 A1 Jul. 17, 2008

(30) Foreign Application Priority Data

Jan. 17, 2007 (DE) ..... 10 2007 003 345

(51) Int. Cl.
*F21V 99/00* (2006.01)

(52) U.S. Cl. ..... 362/231; 362/85

(58) Field of Classification Search ..... 362/85, 362/231, 213

See application file for complete search history.

(56) References Cited

U.S. PATENT DOCUMENTS 5,384,519 A * 1/1995 Gotoh ..... 362/231
5,803,579 A 9/1998 Turnbull ..... 362/83.1
6,932,500 B2 * 8/2005 Takai ..... 362/231
7,423,705 B2 * 9/2008 Len-Li et al. ..... 362/231
2006/0186819 A1 8/2006 Young ..... 315/158
2008/0225520 A1 * 9/2008 Garbus ..... 362/231
2009/0121641 A1 * 5/2009 Shih ..... 362/231

* cited by examiner

*Primary Examiner*—David V Bruce
(74) *Attorney, Agent, or Firm*—Andrew Wilford

(57) ABSTRACT

A lighting control system has at least one light fixture for illuminating buildings or partial surfaces thereof or goods or objects. Each light fixture has a plurality of light sources that generate light of different colors, and each fixture produces a total light output as a sum or mixture of the light emissions of these light sources. The control system itself has at least one control for adjusting the light emitted by the light source, a color selector that sets the color of the total light output, and a balancer that retains a set color of the total light output when a light output of at least one of the light sources is changed.

15 Claims, 3 Drawing Sheets

LIGHTING CONTROL SYSTEM

FIELD OF THE INVENTION

The invention relates to a lighting-control system comprising at least one light fixture for illuminating buildings or partial surfaces thereof or goods or objects, the light fixture having a plurality of light sources that generate light of different colors, the control system comprising at least one controller for adjusting the light emitted by the light source, the light fixture producing a total light output as a sum or mixture of the light emissions of the light sources, the controller having a color selector that sets the color of the total light output.

BACKGROUND OF THE INVENTION

Such a lighting-control system is known from public prior use. It is a lighting-control system that can have one or a is plurality of controls in the form of computers. The control system is connected to a plurality of light fixtures via a network. Light fixtures that have only one lamp can be connected to the control system, but by the same token light fixtures that have a plurality of different colored lamps can also be connected. Those lamps, which can also be called light sources, can be LED's, colored fluorescent lamps, or any other type of conventional or future light source.

Software commercially available from Applicant under the name Lamp Studio can run on the control system that can be formed by a conventional PC or a specially adapted computer. The software offers the opportunity to set the parameters of the individual light fixtures in numerous different ways via a user interface. For instance, by means of an input apparatus, e.g. a conventional computer mouse, an operator can specify that a specific light fixture is to generate a specific color mix. If a specific light fixture that is to be addressed includes for instance one red, one green, and one blue light-emitting diode (LED), the three individual light sources can be addressed in a specific manner to produce practically any color mix from a total light output. In doing so, it is assumed that the light emitted by the different light sources is mixed together to create a light mix using suitable mixing devices such as reflectors, diffuser plates, or based on geometric arrangements of the LED's, as is well known from the prior art. The light that leaves the light fixture can be described as total light output and a color mix can be assigned to this total light output.

If all three described light-emitting diodes are addressed, the light fixture generates for instance white light. If only the red light-emitting diode is addressed, while the green and the blue LED's remain switched off, the light fixture generates red light.

U.S. Pat. No. 5,803,579 describes the manner in which differently colored LED's can provide a homogeneous total light mix with their individual spectral distributions.

As complexity has increased in light fixtures, and this complexity is expressed not only in the increasing number of differently colored light sources, the need to also satisfy increasingly more complex illumination tasks and functions with these light fixtures has also grown. In particular but not exclusively in the field of store lighting, in which in particular goods offered for sale are to be illuminated, there is the desire to be able, on-site, that is for instance in a store, to use a lighting-control system that makes it possible to adapt the light produced by the lighting-control system to specific goods in an efficient manner.

OBJECT OF THE INVENTION

The underlying object of the invention is therefore to further develop a lighting-control system in accordance with the preamble of claim 1, which system is known, such that it can be used in a particularly variable manner.

SUMMARY OF THE INVENTION

The invention attains this object with the features of claim 1, in particular with the characterizing portion, and is consequently characterized in that the control system has a balancer that, with a set color mix, can change a light output of at least one light source can while retaining this color mix.

The principle of the invention is essentially comprised in that a balancer is also provided in a lighting-control system having a color selector. Once the user has set a color mix for a specific light fixture, or for all of the light fixtures connected to the lighting-control system, balancing can be done, by means of which light sources or portions thereof mix can generate this color mix.

For instance, it is conceivable that a total light output is generated by a plurality of light sources. In the simplest case, it is conceivable that a light fixture has one red, one green, and one amber LED. The color mix of the total light output can now be selected, for instance amber. This color mix can for instance be generated in that the red and the green LED's are switched off and only the amber LED is switched on. By the same token, however, the amber LED can also be switched off and only the red and the green LED's can be addressed, in equal parts, for instance at 100% or 75% of their maximum output. Finally, it is also possible for all three LED's, that is, for the red LED, the green LED, and the amber LED, to be operated at 50% of its maximum intensity. In each of the three control scenarios described, the result is that the color mix of the total light output is practically undifferentiatable.

However, if only the amber LED is switched on, the total light output does not contain any portions of red or green light. If there is a desire to illuminate with amber color in the area of a sales surface, e.g. a wall, and if there are red or green colored goods in the vicinity of the wall, the natural colors of which are to be emphasized, it can be useful to create the desired amber total light from red and green LED light output portions. This can occur in that the red or the green light source is changed using the balancer for the light output. The balancer simultaneously ensures that the color mix is retained despite the change in individual light outputs. The degree to which the light outputs of the other light sources must change in order to retain the color mix can be calculated automatically, in particular using a calculating device. In this manner comparable illumination can be created, e.g. continuous illumination or lighting a wall in the store room with basic amber color, whereby however a change in the spectral composition of the total light output and the associated color mix results in adapting to the different goods to be illuminated.

It is clear that the selected example of a light having only three LED's with red, green, and amber color merely simplifies the illustration of the inventive principle. As a result it will be possible also to design in the inventive manner in particular light fixtures that comprise numerous LED's or other light sources of different colors, and that for instance can have five or six differently colored LED's. In this manner it is also possible for instance to adjust a white color mix and to accent colored goods while accenting specific spectral portions.

The invention relates in particular to building light fixtures that are provided for secure attachment to a building wall, for installation on a feed line, e.g. a power rail, in either a ceiling, wall, or floor. Such light fixtures in particular illuminate building surfaces in the interior or exterior or illuminate goods or objects such as statues or pictures or conventional goods for sale.

In accordance with the invention, lighting-control systems are in particular suitable for the field of shop illumination, but can also illuminate any other surfaces. For instance, passages or areas of a building can be illuminated with an adjustable color mix, while e.g. architectural details, such as windows visible from outside that have a specific color that differs from the color of the passages can be accentuated by mixing spectral light portions of this specific color.

Preferably each individual light source of each light fixture connected to the lighting-control system can be addressed individually. However, the formulation according to which "the light sources can be controlled for adjusting or for changing the light output they are to emit" also includes those light fixtures in which a plurality of differently colored light sources can only be addressed or controlled as a whole. What is critical is that the user can select which color the total light output has by adding a color mix at the control system. For this, the individual light sources must be able to be addressed by the control system, in particular via a signal line.

The balancer can be embodied in the form of one or a is plurality of controls, e.g. sliding or rotary controls, as is known for instance for equalizers. The controls can be assigned to the colors of the different light source. Thus for instance in the case of the above-described light fixture with three different LED's one controller can be provided for setting the light output of the green-colored LED, one can be provided for setting the light output of the red-colored LED, and one can be assigned to setting the light output of the amber-colored LED. If the user in the above-described example has set a light fixture having three LED's to the amber color mix, and wants to emphasize the portion of green light in order to accentuate green goods, he can generate a maximum possible green light output by actuating the controller assigned to the green LED.

Preferably the balancer has a calculating device that automatically ensures that when the controller for the green LED is actuated the controller for the red LED is also actuated by the same measure and at the same time the controller for the amber LED is pulled back. The concurrent movement of the controls is calculated automatically in order to retain the set color mix.

It is clear to the observer that if such an automatic device were not present and a user was to raise the controller responsible for the green LED, otherwise a change in the color mix would occur. It is precisely this that is to be avoided with the inventive balancer, however.

The control system can have a display device that indicates or depicts the spectral composition of the total light output—corresponding to the current setting of the balancer—or the spectral composition of the partial light outputs emitted by the individual light sources. In the case of the light fixtures having three differently colored LED's, the three LED's can for instance be shown in a coordinate system, the x-axis of which represents the wavelength, and the corresponding intensities can be depicted as a function of the current position of the control. In addition, the sum flux or total light output, including the spectral distribution of the total light emitted by the light fixture, can be shown in this manner.

It is significant that, due to addressing the color selector or the balancer by the user, the control system can initiate a real-time change in the light outputs emitted by the individual light sources. In particular the inventive system can be a lighting-control system that communicates signals in accordance with the DALI protocol.

The inventive lighting-control system relates in particular to a network of light fixtures in which a plurality of light fixtures is connected via a signal line to one or a plurality of controls. The inventive control system can also be a component of a single light fixture, however, and have for instance a color selector and balancer attached directly to a housing on the light fixture.

BRIEF DESCRIPTION OF THE DRAWING

Additional advantages of the invention result from the dependent claims that were not cited and using the embodiment of the invention that is shown and described in the following figures.

SPECIFIC DESCRIPTION

Figure 1:
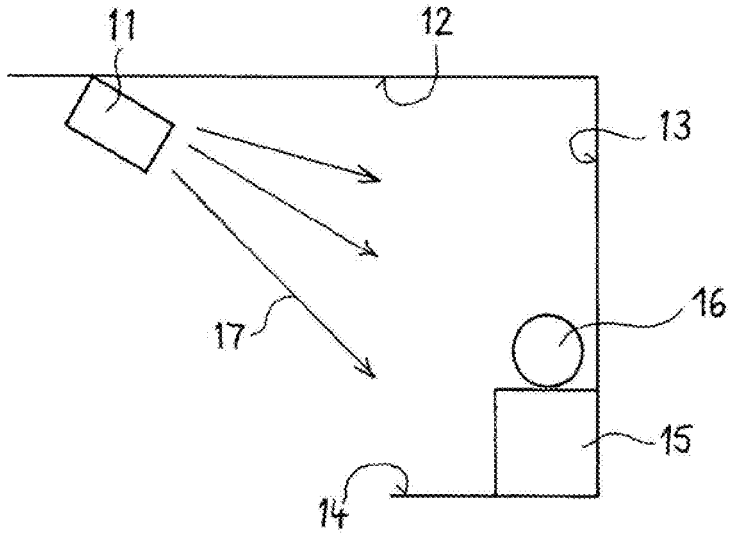
FIG. 1 is a very schematic side view of a room in a building in which a light fixture from the inventive lighting-control system is arranged on the ceiling and illuminates a wall and an object.

The lighting-control system labeled 10 overall shall be described in the following using the illustrated embodiments in FIGS. 1 through 5. It should first be noted that when identical parts are described or elements, or parts or elements are described that are comparable to one another in terms of their function or action, they are identified with the same number, sometimes with the addition of a lowercase letter.

The lighting-control system 10 controls a plurality of light fixtures. It shall first be made clear using FIG. 1 as an example that a light fixture 11 can be attached for instance to a ceiling 12 of a shop room in a building and can illuminate a wall surface 13, where necessary also a floor surface 14, and in particular goods 16 that are arranged for instance on a shelf 15 in front of the wall 13. However, it is clear to the observer that it is equally possible for a light fixture 11 of an inventive lighting-control system to be installed on the wall or floor or to illuminate exterior surfaces.

Figure 2:
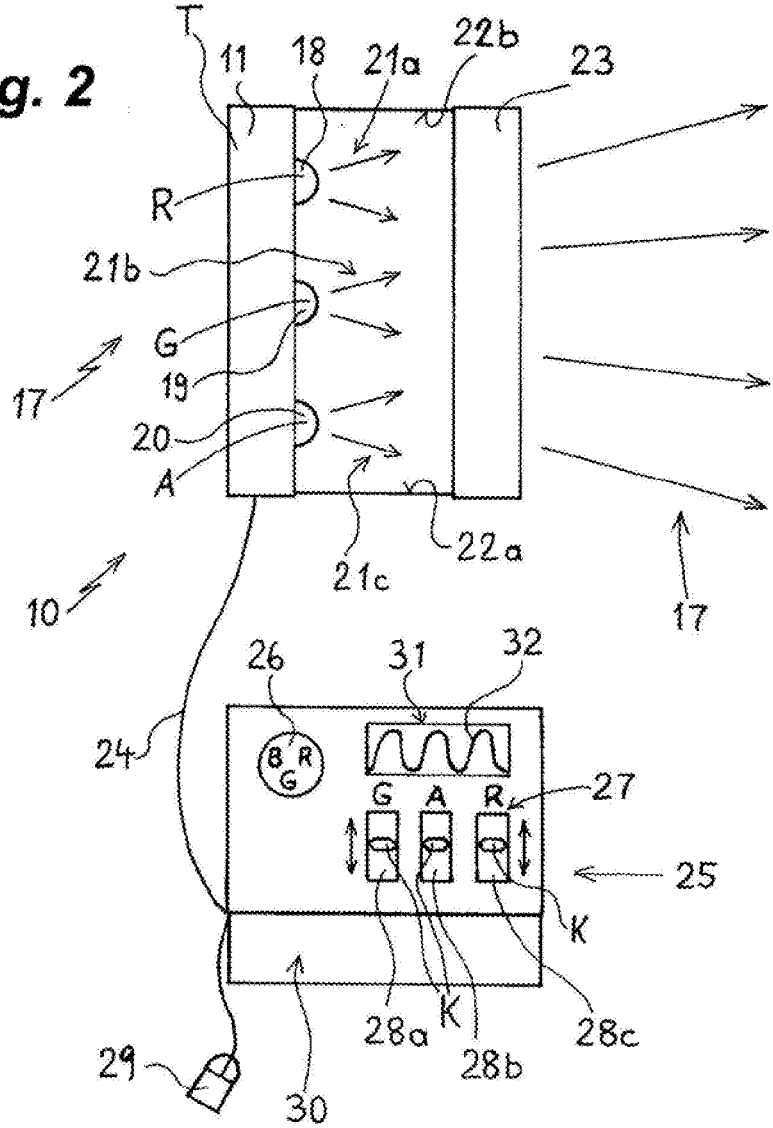
FIG. 2 is an enlarged, circuit diagram-type illustration of the light fixture in accordance with FIG. 1 that is connected to a control, for instance like a conventional computer that has a color selector and an inventive balancer.

A light fixture 11 as component of an inventive lighting-control system 10 shall first be explained using FIG. 2. Accordingly, a support plate T are a plurality of differently colored light sources, in the illustrated embodiment in FIG. 2 one red LED 18, one green LED 19, and one amber LED 20. Coming from each of the light sources is a partial light beam 21*a*, 21*b*, 21*c* that is only indicated schematically with arrows. Using for instance reflectors arranged on the side walls 22*a* and 22*b* of a housing for the light fixture 11 and/or using in particular a diffuser plate 23, for instance in the form of anti-dazzle glass, it is possible to mix the different partial light outputs 21*a*, 21*b*, 21*c* to create a largely homogeneous total light output 17. This total light output 17 is also shown in FIG. 1. According to it, in the illustrated embodiment in FIG. 1 the goods 16 and the wall 13 are illuminated with a total light output 17 of a largely homogeneous color mix.

As can be seen in FIG. 2, the light fixture 11 is connected via a signal line or control line 24 to a controller 25. The control system 25 can be for instance a conventional computer or a specially adapted control device. A color selector 26, indicated just very schematically as a color wheel in FIG. 2, belongs to the control system 25. Blue, green, and red areas of the entire color spectrum that can be generated with the light fixture 11 are described in the color wheel 26 with the letters b, g, r. The color wheel 26 naturally also includes different white tones and secondary tones. Using a computer mouse 29, a cursor (not shown in FIG. 2) or similar position indicator can be positioned within the color wheel 26 and a color mix can be set for the total light output 17 by selecting, for instance by clicking a mouse button. Setting color saturation can also belong to setting the color mix. In particular the data are transmitted in real-time so that at the moment at which the operator changes the color mix using the positioning device 29, corresponding signal information is transmitted via the signal line to the light sources or their drivers in order to ensure that the individual light sources generate corresponding partial light outputs that mix together to create the desired color mix.

The control system 25 inventively has a balancer 27 that in the illustrated embodiment comprises three individual controls 28*a*, 28*b*, 28*c*. The controls are slide controls with operating knobs K that can be moved as shown by the double-headed arrow. A display 31 is shown above the three controls, and it shows a spectrum curve 32 of the light outputs that are generated by the selection of the color mix and by the setting of the balancer and that is generated by the light fixture 11. A calculating device, indicated schematically, also belongs to the control system 25 and for instance can be provided by a conventional computer. By operating the controls 28*a*, 28*b*, 28*c*, the spectral composition of the light output 25 can be modified without the color mix previously set being changed. This shall be explained in the following using FIG. 3 through FIG. 5.

Figure 3:
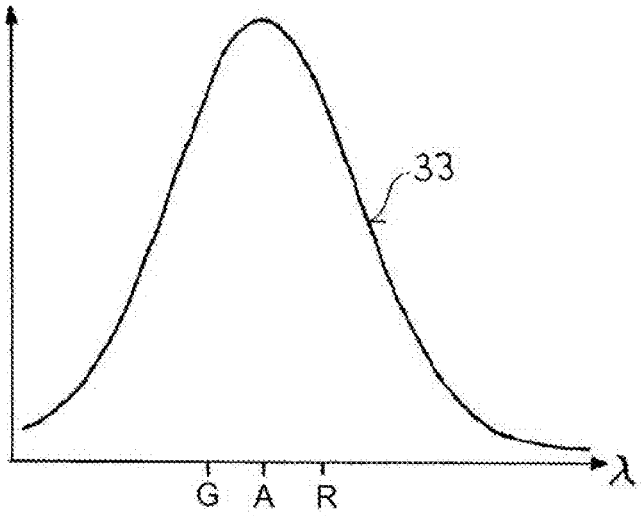
FIG. 3 shows the spectral curve of a total light output of the light fixture in the amber color mix set in FIG. 2, which color mix is generated solely by an amber light source.
Figure 4:
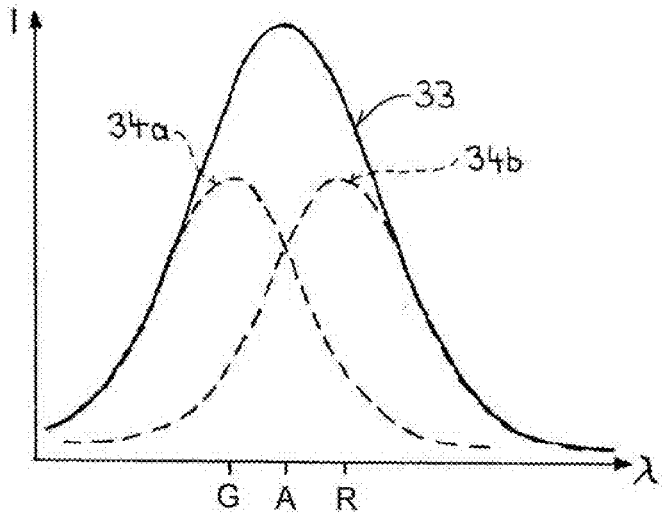
FIG. 4 shows the spectral light distribution of the same light fixture with the same set color mix, the amber light source being switched off in this case.
Figure 5:
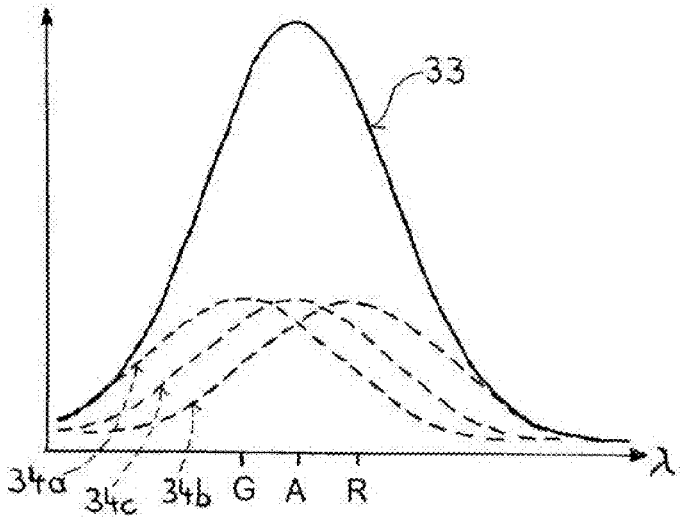
FIG. 5 shows the spectral light distribution of the light fixture with the same color mix, the red, green, and amber light sources being controlled with the same intensities.

FIGS. 3 through 5 relate to the illustrated embodiment of a light fixture 11 in accordance with FIG. 2 in which one green, one amber, and one red light source, are provided, e.g. in the form of light-emitting diodes or fluorescent lamps. In the following the illustrated embodiment in FIGS. 3 through 5 will be described assuming that it is a light fixture having one red, one green, and one amber LED, although the spectral curves explained in the following and shown in FIGS. 3 through 5 are clearly broader than for currently commercially available LED's that have comparatively narrower spectra. The description of FIGS. 3 through 5 is merely intended to convey the understanding of the invention, it being clear to one skilled in the art that any suitable light source can be used.

FIG. 3 illustrates the curve of the spectral intensity that is generated when the amber color mix is set if only the amber light source, e.g., LED, is activated and the red and green LED's are switched off. The resultant spectral curve is labeled 33 in FIG. 3.

Assuming the goods 16 on the shelf 15 in the presentation rooms of the building possess for instance a green exterior surface and this green exterior surface is to be accentuated. In the case of activating the light fixture 11 in accordance with FIG. 2, having a spectral curve of FIG. 3, only amber light is produced that is generated only by the amber LED. However, there may be the desire, while retaining illumination of a wall 13 with amber color, to accentuate the goods 16 such that the spectral green portion of the amber light mix is increased. For this, the controller 28*a* for the balancer 27 and belonging to the green LED can be activated and moved upward for instance with respect to FIG. 2. Because of this, initially the green LED is switched on and then is switched with increasing strength until approximately the curve of the light output 21*b* labeled 34*a* in FIG. 4 and generated by the green LED 19 is attained.

The red LED is switched on automatically, as well, by the same measure as the green LED is switched on, and the amber LED is switched off. The total spectral curve 33 that results from summing the individual partial light output 34*a*, 34*b* should remain large unchanged. This ensures that the color mix that is set (amber) is maintained.

If green spectral portions are added due to generation of the curve 34*a* in accordance with FIG. 4, red portions must therefore necessarily be added by switching on the red LED, which is indicated by the spectral curve 34*b* (broken line-curve in FIG. 4). However, the amber LED must also be switched off or dimmed by the same measure. The amber LED is switched off completely in a switching state in accordance with FIG. 4.

If the goods 16 and the wall 13 were to be addressed with total light 17 in accordance with a switching state in FIG. 4, the green goods 16 (or similarly any red goods present) would be correspondingly accentuated without the wall 13 being illuminated with a color that is different from the switching state in accordance with FIG. 3. The wall 13 is illuminated the same in the two switching states in accordance with FIGS. 3 and 4.

As just explained, in the illustrated embodiment in FIG. 4 and also in the subsequent illustrated embodiment in FIG. 5, which will be explained in the following, it can be provided that the total spectral curve 33 resulting from the summation of the individual partial light outputs 34*a*, 34*b* remains essentially unchanged. In an illustrated embodiment to be explained later using FIGS. 6 and 7, the total spectral curve can certainly change, however, without changing the color mix. For this, the dominant wavelength that can be perceived by the human eye is determinant.

Finally, FIG. 5 is intended to clarify a situation in which all three LED's, namely the red, green and amber LED's, are switched on. Correspondingly, partial light output curves 34*a*, 34*b*, 34*c* result, all of which are shown in broken lines. In this case as well, the spectral intensity curve for the total light output 17 in the form of the curve 33 is identical to that in FIGS. 3 and 4.

In other words, the inventive lighting controller leaves the color mix of the total light output 17 unchanged, while it can change the spectral portions. The composition of the light mix can thus be changed. Specific objects or surfaces having a specific color can be emphasized or accentuated by changing the spectral composition. Conversely, changing the color mix to avoid a specific color accentuation can also be an objective. Specific architectural details or other differently colored areas or passages of surfaces to be illuminated can in this manner remain unaccented or be relegated to the background. Alternating accentuation and deaccentuation can also be desired in the framework of scenographic illumination.

The invention has been described using one light fixture 11 having only three differently colored LED's. Preferably an inventive light fixture has five or more differently colored light sources, however, in particular LED's. Thus in particular there is the idea of providing at least one red, one green, one blue, on yellow, one cyan, one amber, and one white LED. There is therefore in particular the opportunity to generated white total light 17 using a light fixture and to nevertheless emphasize objects or surfaces of a certain color by accentuating specific spectral color portions.

It is obvious that a plurality of light fixtures 11 can be controlled with one controller 25. The number of controls 28*a*, 28*b*, 28*c* then preferably corresponds to the number of different colored light sources used. At least as many controls are provided as there are usefully addressable light sources that can be changed in terms of their partial light output.

It should furthermore be noted that the schematically indicated calculating unit 30 can compute automatically the limits within which spectral portions of specific light sources can be replaced by other spectral portions. For instance, it can be conceivable with a specifically selected color mix that a specific spectral portion must not be removed or the color mix changes. Correspondingly, a corresponding controller assigned to his LED could also be blocked or even not addressable at all. On the other hand, in one preferred embodiment of the invention, it is conceivable that a controller will permit a specific light color to be switched on or dimmed only by a certain measure. Thus in the illustrated embodiment of FIG. 4 it is clear that the green LED can only contribute a maximum light output corresponding to the broken curve 34*a*. If the light output of the green LED were to be increased further, the area of the broken curve 34*a* to the left in FIG. 4 would rise above the curve 33 shown with a solid line and thus possibly change the color mix.

With respect to the illustrated embodiment in FIGS. 3 through 5, it should be noted that the most visible spectral intensity distributions 34*a*, 34*b*, and 34*c* of the individual light source, namely of the green, amber, and red LED's, are shown with an exaggerated, very wide, largely bell-shaped, nearly gauss-shaped spectral distribution. This is also true of the spectral distributions in FIG. 4 that are labeled 34*a*, 34*b* and the spectral total light output distribution labeled 33. It should be noted that such spectral distributions in the form of wide bell-shapes can be assigned to illuminations means that are commercially available on the market, sometimes fluorescent lamps, but not to LED's. LED's emit light with a spectral intensity curve that has a much narrower band than illustrated in FIGS. 4 and 5.

Figure 6:
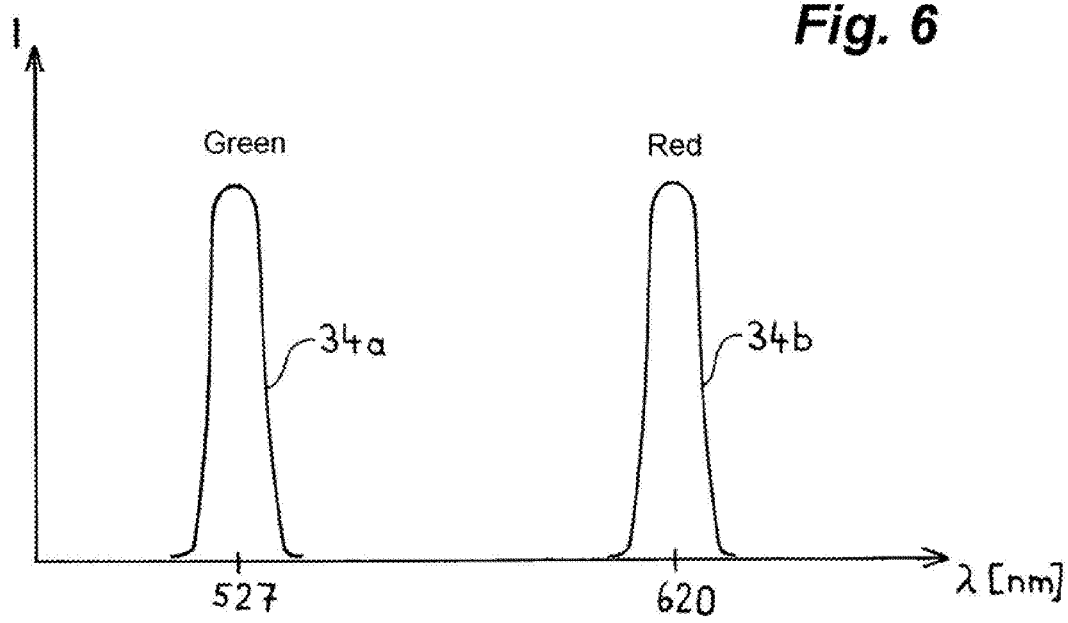
FIG. 6, like FIG. 4, shows the spectral curve of two partial light outputs that are emitted by one green and one red LED, the dominant wavelength being between the two peaks, specifically at amber.
Figure 7:
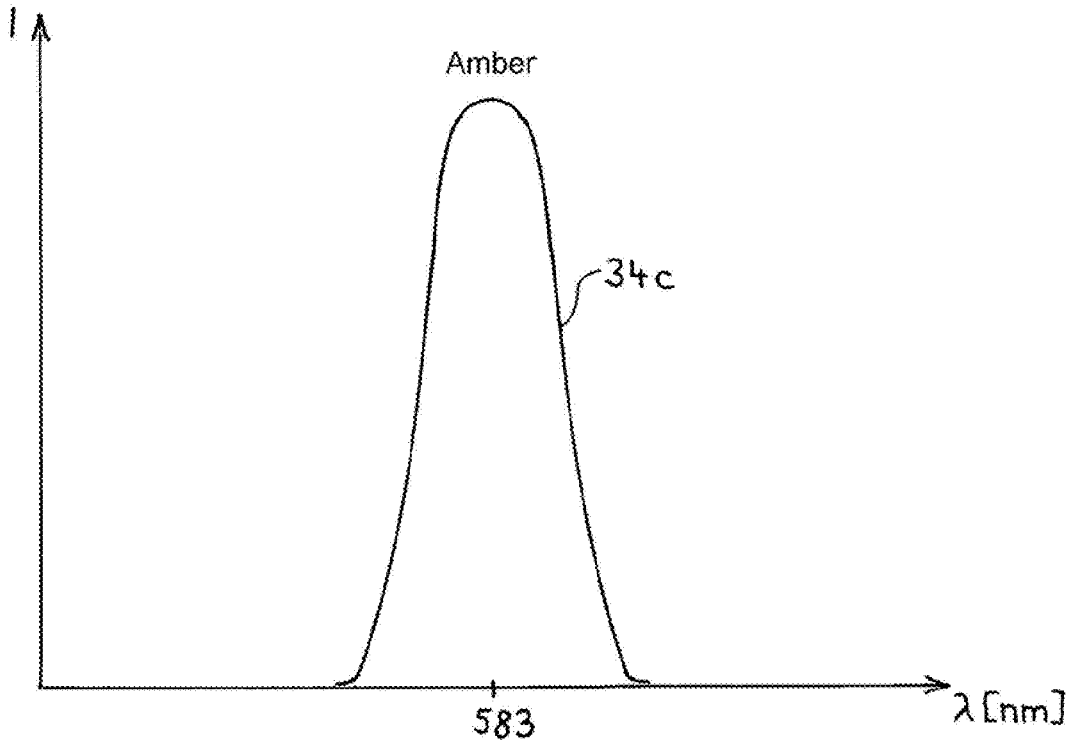
FIG. 7, in a view in accordance with FIG. 6, indicates the spectrum that results from switching off the green and the red LED's and switching on the amber LED.

FIGS. 6 and 7 depict a spectral curve that actually results when using LED's. FIG. 6 shows a light fixture in which the one amber LED (wavelength 583 nm) is switched off and a green LED (at 527 nm) and a red LED (at 620 nm) are switched on. The spectral curves of the partial light outputs are labeled 34*a* and 34*b* there and, as is evident with nothing further, are clearly narrower than the spectral curves shown in FIGS. 4 and 5. There is practically no partial flux intensity in particular in the area of the dominant wavelength at 583 nm. However, the human eye will perceive the total light output that is composed of the partial light outputs from the red and green portions in accordance with FIG. 6 having a dominant wavelength at 583 nm and in this manner will recognize amber light.

FIG. 7 shows the light fixture from FIG. 6 in which the red and the green LED's have been switched off and the amber LED has been switched on. The spectral curve of the partial light output emitted by the amber LED is labeled 34*c*. The color mix of the total light output in accordance with FIG. 7 corresponds to that of the total light output of the light fixture in a switching state in accordance with FIG. 6.

As is evident from FIG. 6, the spectral intensity distributions in LED's are so narrow that there is no overlapping.

The illustrations in FIGS. 3 through 5 are therefore only useful for explaining the inventive principle and can be read on light means with broad, bell-shaped intensity distributions.

The inventive principles can also be used in the same manner, however, when using very narrow-band LED's as light sources. Thus when using very narrow-band green, amber, and red LED's it should be noted that due to spectral sensitivity of the human eye that has only red, green, and blue color receptors, a corresponding spectral overlap occurs in the human eye. If for instance equal portions of red and green light, each generated from the light fixture in accordance with FIG. 6 by an LED, and if consequently there is practically no intensity of the light output that extends beyond the background noise in the area of the wavelength at about 583 nm (corresponding to the color amber), the human eye perceives the total of the green and red light as an amber light.

Even when using narrow-band light sources such as LED's it is thus possible to effect a change in the light output of individual light sources by addressing the balancer without changing the color mix of the total light output.

The invention claimed is:

1. A lighting control system comprising at least one light fixture for illuminating buildings or partial surfaces thereof or goods or objects, the light fixture having a plurality of light sources that generate light of different colors, the light sources being LEDs, and at least one controller for adjusting the light emitted by the light sources, the light fixture producing a total light output as a sum or mixture of the light emissions of the light to sources, the controller having a color selector that sets the color of the total light output, the controller having a balancer that retains a set color of the total light output when a light output of at least one of the light sources is changed.

2. The lighting control system according to claim 1 wherein the light sources are at least three LEDs of different colors.

3. The lighting control system according to claim 1 wherein the light sources are at least four LEDs of different colors.

4. The lighting control system according to claim 1 wherein the light sources are at least five LEDs of different colors.

5. The lighting control system according to claim 1 wherein the light sources are at least six LEDs of different colors.

6. The lighting control system according to claim 1 wherein the light sources include at least one red LED, at least one blue LED, at least one yellow LED, at least on amber LED, and at least one cyan LED.

7. The lighting control system according to claim 6 wherein the light sources also include at least one white LED.

8. A lighting control system comprising:

at least one light fixture for illuminating buildings or partial surfaces thereof or goods or objects, the light fixture having a plurality of light sources that generate light of different colors, and at least one controller for adjusting the light emitted by the light sources, the light fixture producing a total light output as a sum or mixture of the light emissions of the light sources, the controller having a color selector that sets the color of the total light output, the controller having a balancer that retains a set color of the total light output by changing the spectral composition of the total light output when a light output of at least one of the light sources is changed.

9. The lighting control system according to claim 8 wherein the balancer has a plurality of the controllers each associated with a respective one of the sources.

10. The lighting control system according to claim 9 wherein each controller adjusts the light output of a respective light source.

11. The lighting control system according to claim 9 wherein the balancer includes at least three controls each serving a respective light source.

12. The lighting control system according to claim 9 wherein the number of controls corresponds to the number of light sources.

13. The lighting control system according to claim 8 wherein the balancer cooperates with a calculating unit that automatically changes the light output of one of the light sources to maintain the selected color mix.

14. The lighting control system according to claim 8, further comprising a display that shows or displays the spectral composition of the total light output or the components thereof.

15. The lighting control system according to claim 8, further comprising automatic means for, with a set color mix, offering the user a suggestion of which light sources can be varied with respect to their light outputs to maintain the color mix.

* * * * *